US007377744B2

(12) United States Patent
Urban et al.

(10) Patent No.: US 7,377,744 B2
(45) Date of Patent: May 27, 2008

(54) MULTISTAGE CENTRIFUGAL PUMP

(75) Inventors: Joerg Urban, Ludwigshafen (DE); Wolfgang Kochanowski, Windesheim (DE); Bernhard Brecht, Nuestadt (DE); Stephan Scharpf, Worms (DE)

(73) Assignee: KSB Aktiengesellschaft, Frankenthal (DE)

( * ) Notice: Subject to any disclaimer, the term of this patent is extended or adjusted under 35 U.S.C. 154(b) by 362 days.

(21) Appl. No.: 11/280,317

(22) Filed: Nov. 17, 2005

(65) Prior Publication Data

US 2006/0127232 A1 Jun. 15, 2006

Related U.S. Application Data

(63) Continuation of application No. PCT/EP2004/004873, filed on May 7, 2004.

(30) Foreign Application Priority Data

May 17, 2003 (DE) ..... 103 22 382.7

(51) Int. Cl.
*F04D 29/046* (2006.01)

(52) U.S. Cl. ..... 415/199.1; 415/229

(58) Field of Classification Search ..... None
See application file for complete search history.

(56) References Cited

U.S. PATENT DOCUMENTS 4,669,956 A 6/1987 Brunel et al.
4,865,529 A 9/1989 Sutton et al.
5,201,633 A * 4/1993 Peu ..... 415/146

FOREIGN PATENT DOCUMENTS

| | | |
|---|---|---|
| DE | 2 204 995 | 8/1972 |
| DE | 26 14 163 B1 | 3/1977 |
| DE | 42 27 249 C2 | 2/1994 |
| EP | 0 318 638 A2 | 6/1989 |

OTHER PUBLICATIONS

International Search Report Form PCT/ISA/210.
German Office Action dated Jan. 15, 2004.

* cited by examiner

*Primary Examiner*—Richard A. Edgar
(74) *Attorney, Agent, or Firm*—Crowell & Moring LLP

(57) ABSTRACT

A multistage centrifugal pump in which each stage includes a one-piece or multi-piece housing and an impeller disposed therein. The pump stages are arranged between an inlet end member and an outlet end member and retained therebetween by connectors so as to be connected to a flow-guiding system. All impellers are positioned on a single pump shaft that is supported by at least two pump bearings. One end of the pump shaft is provided with a device for receiving a connector of a drive unit, and outer support members are disposed at mounting points adjacent the end members in order to mount the centrifugal pump in its installation location. The pump shaft (3) is supported by two two pump bearings (11, 12), with the maximum distance ($L_L$) between confronting sides of the two pump bearings (11, 12) being less than or equal to a minimum structural stage height ($L_M$) multiplied by the number of pump stages (2.1-2.5) minus 1.

18 Claims, 2 Drawing Sheets

MULTISTAGE CENTRIFUGAL PUMP

CROSS REFERENCE TO RELATED APPLICATIONS

This application is a continuation of international patent application no. PCT/EP2004/004873, filed May 7, 2004, designating the United States of America, and published in German as WO 2004/1091117 A1 on Dec. 16, 2004, the entire disclosure of which is incorporated herein by reference. Priority is claimed based on Federal Republic of Germany patent application no. De 103 22 382.7, filed May 17, 2003.

BACKGROUND OF THE INVENTION

The invention relates to a centrifugal pump of multistage type of construction, in which each pump stage has a casing consisting of one or more parts and an impeller arranged in said casing, the pump stages are arranged, for connection to flow-carrying systems, between inlet and outlet end pieces and are held between these by connectors, all the impellers are arranged on one pump shaft supported in at least two pump bearings, a pump shaft end is provided with a receptacle for a connector of a drive, and outer bearing means are arranged in the region of the end pieces in order to fasten the centrifugal pump at an installation location.

Centrifugal pumps of this type which are formed as linked pumps are designed for conveying a fluid at a high pressure level. They are formed as independent appliances, the pump shaft of which is connected to a drive machine, for example an electric motor or a turbine, with a coupling element being interposed. The centrifugal pump and the drive machine are mounted together on a baseplate or on a foundation. They are often used as multistage feedpumps in power plants or in other arrangements where a high pressure is required. As a result of the multistage construction and the arrangement of the pump stages between the end pieces, it is possible, during their production, to adapt in a simple way to different operating conditions by varying the number and type of construction of the pump stages. For this purpose, the connectors and the pump shaft are to be co-ordinated with the corresponding overall length of the centrifugal pump, and a baseplate or a pump foundation is to be designed to correspond to the overall length.

Centrifugal pumps having this general type of construction are known from DE 22 04 995 A1 and DE 26 14 163 B1 and from the KSB Centrifugal Pump Lexicon, third updated edition, page 185. Where these multistage linked pumps are concerned, the respective pump bearings of the pump shafts are arranged outside and at a distance from the end pieces of the centrifugal pump. The distance between the pump bearings is increased due to the necessary space for the shaft seals which are to be attached and by which fluid is prevented from emerging from the casing of the centrifugal pump. A large bearing distance between the shaft bearings which is due to this is a disadvantage in oscillatory terms, since unfavorable oscillations of the rotating component may occur as a result. Also, the absorption of pipeline forces which are conducted into the centrifugal pump via the end pieces has an adverse influence on the conditions of force of the centrifugal pump.

Outer support members serve to fasten such centrifugal pumps at the respective location of use and are provided on the end pieces or else between the end pieces of the centrifugal pump. An unfavorably selected position of these outer support members, which are generally configured as feet, battens or struts, may have, in respect of a built-in centrifugal pump, adverse effects on the oscillatory behavior of the rotating components.

SUMMARY OF THE INVENTION

It is an object of the present invention to provide an improved multistage centrifugal pump.

Another object of the invention is to provide a multistage centrifugal pump in which the oscillatory behavior of the rotating system is optimized and which allows operation at higher rotational speeds.

These and other objects are achieve in accordance with the present invention by providing a multistage centrifugal pump, each pump stage comprising a casing comprised of at least one part and an impeller arranged in said casing; said pump stages being arranged between an inlet end member and an outlet end member axially spaced from the inlet end member and held between the end members by connectors; all of the impellers being disposed on a single pump shaft supported in at least two pump shaft bearings; one end of the pump shaft having a receptacle for a drive connecting member, and outer support members being provided adjacent the inlet and outlet end members for mounting the pump in an installation location; wherein the two pump bearings which are furthest apart are spaced apart a bearing distance which is less than or equal to the product of a minimum pump stage height times one fewer than the number of pump stages.

Thus, in accordance with the present invention, the bearing distance $L_L$ between mutually confronting bearing end faces of two pump bearings at the greatest distance from one another is smaller than or equal to the product of a minimum stage overall height $L_M$, multiplied by the number of pump stages reduced by the value 1.

This solution achieves a particularly rigid design of the rotating part, also called the rotor, of a centrifugal pump. In this case, a bearing end face of pump bearings in the form of plain bearings is arranged at that point at which a plain bearing gap has its start or its inflow orifice. Where rolling bearings are concerned, it is the end surface of a bearing rim which ensures the smallest distance. The extremely small distance between the pump bearings results in a particularly stabilizing design of the entire rotating system. Also, the shaft mounting is arranged in the immediate vicinity of the highly loaded impellers.

The minimum stage overall height $L_M$ critical for the bearing distance is determined by means of a center distance, projected onto the pump shaft and measured in the axial direction, between two impeller outlet widths following one another. A distance between the impeller inlets of impellers following one another could likewise also be used for this purpose.

Embodiments provide for a delivery-side pump bearing to be arranged in a known manner in that projection of the delivery connection piece cross section which is directed onto the pump shaft. A delivery-side pump bearing may likewise be arranged in a last pump stage, or a delivery-side pump bearing is arranged between or in pump stages which precede a last pump stage in the flow direction. In this way, particularly in the case of centrifugal pumps with a double-digit number of pump stages, a substantially more rigid arrangement of a rotor consisting of a shaft and of impellers is obtained.

The purpose of shortening the bearing distance is likewise served by the measures in which a suction-side pump bearing is arranged in a first pump stage, and whereby a suction-side pump bearing is arranged between or in following pump stages which follow a first pump stage.

Those bearings which lie nearest to the respective delivery-side or suction-side end of the pump shaft and between which all or some of the impellers of the pump stages are arranged on the pump shaft, are considered to be outer pump bearings. Also, a pump stage is formed by an impeller together with the surrounding casing consisting of one or more flow-carrying parts. Special accessory components, such as inducers, compensating devices, auxiliary impellers or seals, do not constitute pump stages in this respect.

A rigid type of pump construction is obtained when a distance between bearing centers of two outer pump bearings $L_L$ is equal to or smaller than a distance $L_A$, to be measured in the shaft direction, between the support members. Since the support members are arranged in the region of the end pieces, this results in an overall improved oscillatory behavior. This is because this results in a particularly large-area arrangement of the support members, with the result that the fastening of the centrifugal pump at its later installation location is particularly stable. Pipeline forces acting on the centrifugal pump are thus conducted into a foundation reliably and without adverse effects on the rotating pump part.

The connectors are arranged in a known manner at the end pieces, thus ensuring that the main parts of the centrifugal pump are held together.

Since the suction-side bearing of the pump shaft is always arranged within the pump casing, an additional shaft seal is saved, as compared with a bearing arrangement in which the pump bearings are arranged outside the pressure-carrying casing, and an improvement in operating reliability is obtained. The shortened bearing distance improves, overall, the oscillatory behavior of the rotating component.

In accordance with another advantageous embodiment, a delivery-side bearing is arranged in the outlet end piece. This measure, too, improves the force flux between a pipeline to be connected to the centrifugal pump and a foundation at the installation location. A rectilinear force flux which is thereby possible no longer exerts any adverse effect on the oscillatory behavior of the rotating part.

The arrangement of a shaft seal in the region between a shaft end and the nearest pump bearing has likewise proved advantageous, since the more rigid shaft mounting results in lower seal loads.

The inlet and/or outlet end pieces are produced as separate components and bear against pump stage parts in a force-transmitting manner. The inlet and/or outlet end pieces may likewise be integral constituents of pump stage parts.

In the case of a large number of pump stages, for example when more than ten pump stages are used, it has proved advantageous if a minimum bearing distance $L_{Lmin}$ to be measured between mutually confronting bearing end faces is determined from a number of pump stages, reduced by a value 2 to 5, multiplied by a minimum stage overall height.

BRIEF DESCRIPTION OF THE DRAWINGS

The invention will be described in further detail hereinafter with reference to illustrative preferred embodiments shown in the accompanying drawing figures, in which.

DETAILED DESCRIPTION OF PREFERRED EMBODIMENTS

Figure 1:
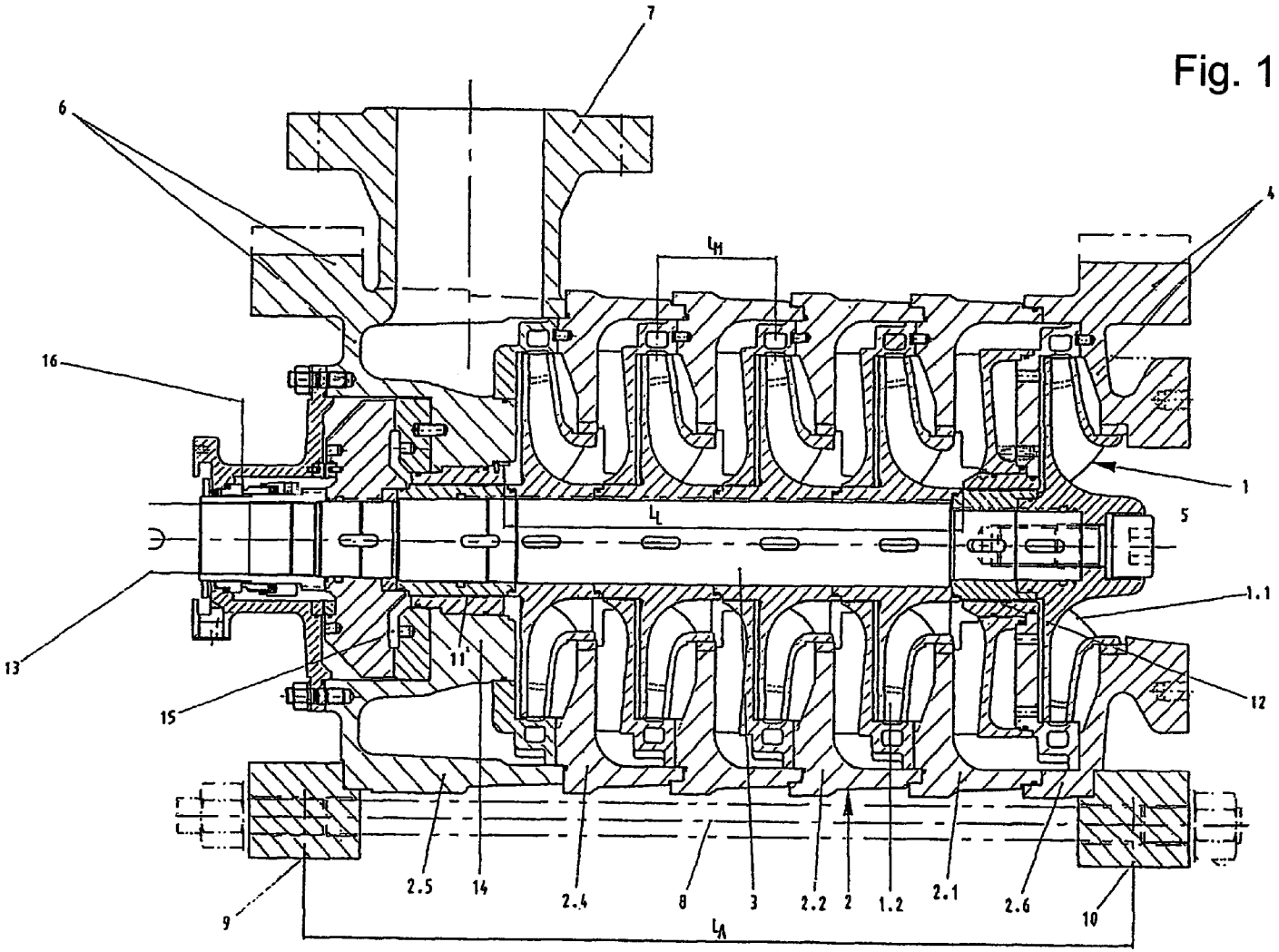
FIG. 1 is a sectional view through a centrifugal pump according to the invention.

In the illustrative embodiment shown in FIG. 1, a five-stage centrifugal pump is depicted, the impellers 1 of which rotate in the casings 2 of each stage and which are fastened together on a pump shaft 3. The pump stages are arranged between an inlet end piece 4 and an outlet end piece 6 and have pump stage parts 2.1-2.5 which are of pressure-carrying design and receive further flow-carrying fittings. In the example, the pump stage parts 2.1-2.4 are constructed as identical parts. The inlet end piece 4 is designed in two parts in the lower half of the illustrative embodiment, its separate annular component 4 bearing against the pump stage part 2.6 of the first stage in a force-transmitting manner. This pump stage part 2.6 at the same time contains the suction port 5 of the centrifugal pump and performs the function of a casing cover. In the upper half of the illustrative embodiment, the pump stage part 2.6 of the first stage is an integral constituent of the inlet end piece 4 and consequently forms one component.

There is a similar behavior with regard to the outlet end piece 6. It is of multipart construction in the upper half of the drawing, and the pump stage 2.5 of the last (in this case fifth) pump stage is a constituent integrated therein. The pump stage part 2.5 is made longer than the preceding pump stage parts 2.1-2.4 of the other pump stages. It contains a larger collecting space, out of which issues a delivery connection piece 7, through which a conveyed fluid is conducted into a pipeline system connected thereto.

The outlet end piece 6 is produced as a separate annular component in the lower half of the drawing and is illustrated as an integral constituent of the casing 2.5 in the upper half of the drawing. It forms at the same time the abutment for outer connectors 8 by which all the pump parts are held together. The connectors 8 shown here are ties which are led through corresponding orifices of the end pieces 4, 6 and, with the aid of screw elements, ensure that the centrifugal pump is held together.

Arranged at the end pieces 4 and 6 are support members 9 and 10, which make it possible to fasten the centrifugal pump at its future installation location. The distance $L_A$ between the support members 9 and 10 is greater than the distance $L_L$ between the bearings 11, 12 of the pump shaft 3. A shaft end 13 to be connected to a drive is located in the vicinity of the delivery-side bearing 11 which is arranged in the casing 2.5 of the here last or fifth pump stage. This fifth pump stage has a collar 14 which, starting from the drive-side end of the pump stage part 2.5, projects on a smaller diameter into the pump stage part 2.5 and thus forms the receptacle for the bearing 11. In addition, there is sufficient free space in collar 14 to accommodate an axial-thrust compensating device 15.

The bearing 11 lies approximately in the center of the delivery connection piece 7, with the result that a good distribution of forces in terms of pipeline forces to be absorbed or of oscillatory forces to be dissipated is possible.

In this illustrative embodiment, the other, suction-side bearing 12 of the pump shaft 3 is arranged between the first and the second pump stage and here is supported within the casing 2.1 of the first stage.

A shaft seal 16 is arranged between the bearing 11 and the shaft end 13. The bearings 11 and 12 are designed as medium-lubricated bearings and are lubricated by the conveyed fluid. The bearings may be designed as plain bearings and/or as rolling bearings. Their selection depends on the fluid to be conveyed and on the bearing load which occurs.

Because of the use of medium-lubricated bearings, there is no need for the service intervals for bearing lubrications which are otherwise necessary.

As a result of the arrangement of the bearings 11, 12 between the force-transmitting support members 9 and 10 of the centrifugal pump, pipeline forces which act on the centrifugal pump in the region of the suction port 5 and of the delivery connection piece 7 are absorbed optimally in terms of the oscillatory behavior. The very short bearing distance $L_L$ of the rotating part of the multistage centrifugal pump results in an extremely high oscillation resistance of the rotating system, with the result that the operating reliability of a centrifugal pump of this type is decisively improved.

Further, the short bearing distance $L_L$ between the pump bearings 11 and 12 results in a multistage centrifugal pump of very short build, in which the oscillations of the pump shaft and its critical rotational speed are critically influenced in a positive way. This results in an improved elastic line of the pump shaft, and consequently, as an additional advantage, the gap dimensions between the rotating and stationary pump parts can be reduced. This leads to an increase in efficiency, since gap flow losses are thus appreciably reduced, without the operating reliability being impaired in this case. The shorter type of construction results overall in a cost reduction, since, overall, the use of material and the operating costs are reduced.

Producing the end pieces 4, 6 as separate components has the additional advantage that these can be produced from a different material. If, because of a fluid to be conveyed, the components touched by the fluid must consist of high-grade special steels, then the parts of the end pieces to which the connectors 8 are connected in a force-transmitting manner can consist of a less expensive material in a cost-reducing way.

Figure 2:
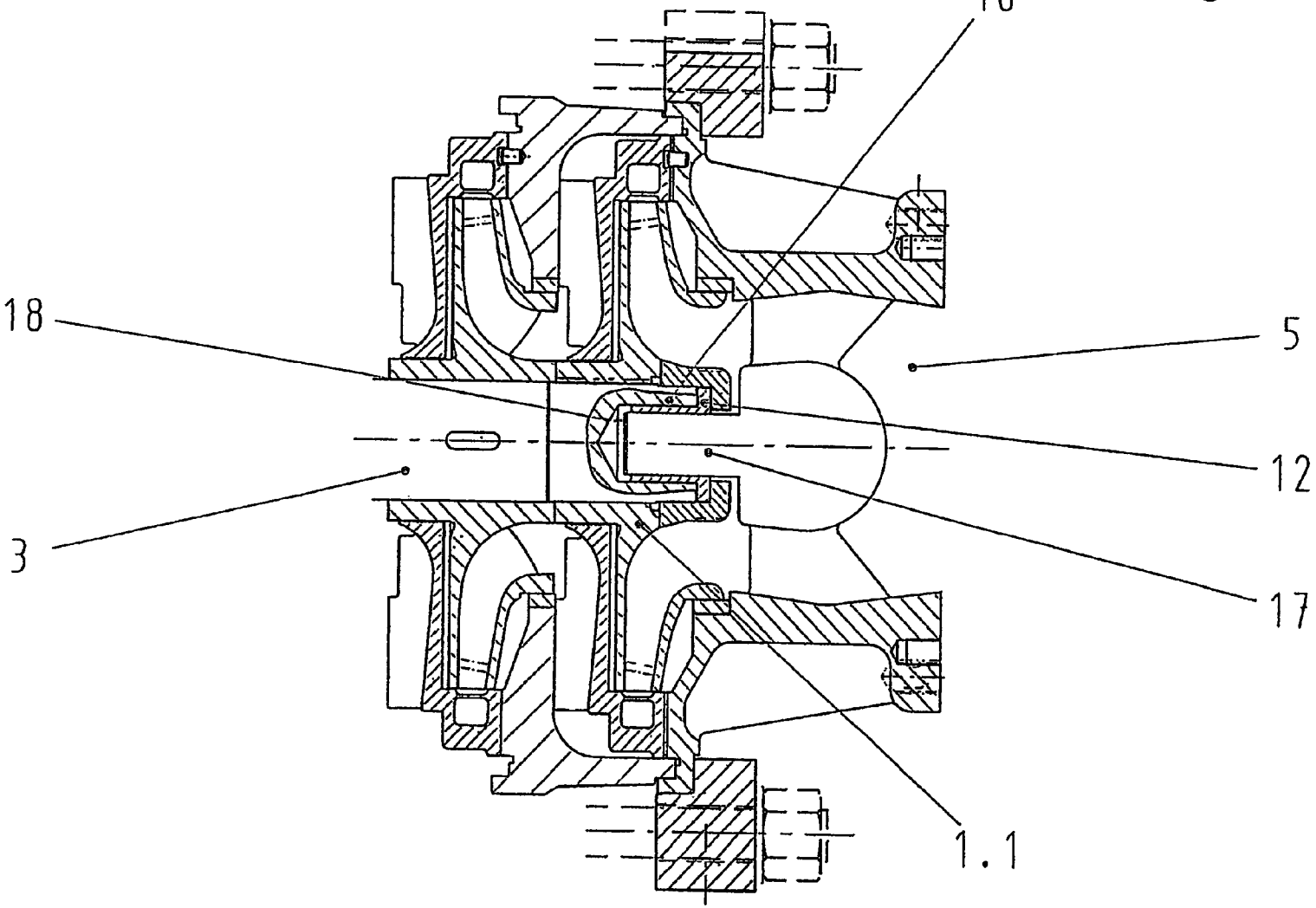
FIG. 2 is a partial sectional view showing a suction-side bearing arrangement.

FIG. 2 shows the use of an entry star which is located within the suction port 5. It has a bearing journal 17 which co-operates with the suction-side pump bearing 12. The pump bearing 12 is in this case built in the form of a bush within a bore 18 of the here suction-side shaft end 18. Fluid circulation through the pump bearing 12 is ensured by corresponding wider lubricating bores (not shown).

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations within the scope of the appended claims and equivalents thereof.

What is claimed is:

1. A multistage centrifugal pump, each pump stage comprising a casing comprised of at least one part and an impeller arranged in said casing; said pump stages being arranged between an inlet end member and an outlet end member axially spaced from the inlet end member and held between the end members by connectors; all of the impellers being disposed on a single pump shaft supported in at least two pump shaft bearings; one end of the pump shaft having a receptacle for a drive connecting member, and outer support members being provided adjacent the inlet and outlet end members for mounting the pump in an installation location; wherein the two pump bearings which are furthest apart are spaced apart a bearing distance which is less than or equal to the product of a minimum pump stage height times one fewer than the number of pump stages.

2. A centrifugal pump according to claim 1, wherein the minimum pump stage height is equal to a minimum axial distance between centers of two successive impeller outlet widths projected onto the pump shaft.

3. A centrifugal pump according to claim 1, wherein the pump shaft bearing proximate the outlet end member is arranged in a projection of a delivery connection piece cross section which extends toward the pump shaft.

4. A centrifugal pump according to claim 3, wherein the pump shaft bearing proximate the outlet end member is arranged in the final pump stage.

5. A centrifugal pump according to claim 3, wherein the pump shaft bearing proximate the outlet end member is arranged in a pump stage which precedes the final pump stage.

6. A centrifugal pump according to claim 3, wherein the pump shaft bearing proximate the outlet end member is arranged between pump stages preceding the final pump stage.

7. A centrifugal pump according to claim 1, wherein the pump shaft bearing proximate the inlet end member is arranged in the initial pump stage.

8. A centrifugal pump according to claim 1, wherein the pump shaft bearing proximate the inlet end member is arranged in a pump stage following the initial pump stage.

9. A centrifugal pump according to claim 1, wherein the pump shaft bearing proximate the inlet end member is arranged between the initial pump stage and a following pump stage.

10. A centrifugal pump according to claim 1, wherein the bearing distance between the two pump bearings arranged at the greatest distance from one another is less than or equal to the axial distance between the support members adjacent the inlet end member and the support members adjacent the outlet end member.

11. A centrifugal pump according to claim 1, wherein the support members are arranged on the respective end members.

12. A centrifugal pump according to claim 1, wherein the connectors are arranged on the end members.

13. A centrifugal pump according to claim 1, wherein the pump shaft bearing proximate the outlet end member is arranged in the outlet end member.

14. A centrifugal pump according to claim 1, further comprising a shaft seal arranged between one end of the pump shaft and the nearest pump shaft bearing.

15. A centrifugal pump according to claim 1, wherein the inlet and and outlet end members are constructed as separate components and bear against interposed pump stage casings in a force-transmitting manner.

16. A centrifugal pump according to claim 1, wherein the inlet and outlet end members are integral components of the casings of interposed pump stages.

17. A centrifugal pump according to claim 1, wherein the bearing distance which the pump shaft bearings are spaced apart is at least equal to the product of the minimum pump stage height times a value equal to 5 fewer than the number of pump stages.

18. A centrifugal pump according to claim 1, wherein the bearing distance which the pump shaft bearings are spaced apart is at least equal to the product of the minimum pump stage height time a value equal to 2 fewer than the number of pump stages.

* * * * *